US009605416B2

(12) United States Patent
Campomanes

(10) Patent No.: US 9,605,416 B2
(45) Date of Patent: Mar. 28, 2017

(54) SPACER SHIMS FOR GROUND ENGAGING TOOLS

(71) Applicant: Caterpillar Inc., Peoria, IL (US)

(72) Inventor: Patrick Simon Campomanes, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 66 days.

(21) Appl. No.: 14/734,955

(22) Filed: Jun. 9, 2015

(65) Prior Publication Data

US 2016/0362873 A1 Dec. 15, 2016

(51) Int. Cl.
*E02F 9/28* (2006.01)
*E02F 3/40* (2006.01)

(52) U.S. Cl.
CPC ..... *E02F 9/2825* (2013.01); *E02F 3/40* (2013.01)

(58) Field of Classification Search
CPC ..... E02F 9/2808; E02F 9/2816; E02F 9/2825; E02F 9/2833; E02F 9/2858; E02F 9/2883; E02F 3/40
See application file for complete search history.

(56) References Cited

U.S. PATENT DOCUMENTS 3,851,413 A 12/1974 Lukavich
3,864,853 A * 2/1975 Klett ..... E02F 9/2841 172/753
5,210,965 A 5/1993 Funk, Sr. et al.
5,526,592 A 6/1996 Bierwith et al.
5,553,409 A * 9/1996 Irving ..... A01B 15/02 172/719
5,653,048 A 8/1997 Jones et al.
6,145,224 A * 11/2000 Stickling ..... E02F 9/2841 37/456
6,986,216 B2 1/2006 Emrich et al.
7,793,444 B2 * 9/2010 Jones ..... E02F 9/2825 37/453
8,819,967 B2 9/2014 Campomanes
9,453,328 B2 * 9/2016 Stangeland ..... E02F 9/2883
2007/0204490 A1 * 9/2007 Jones ..... E02F 9/28 37/452
2013/0047475 A1 2/2013 Bierwith
2014/0082976 A1 3/2014 Vicq et al.
2015/0101218 A1 4/2015 Serrurier et al.

FOREIGN PATENT DOCUMENTS

GB 2093325 9/1982
WO 2014205514 A1 12/2014

* cited by examiner

*Primary Examiner* — Jamie McGowan
(74) *Attorney, Agent, or Firm* — Procopio, Cory, Hargreaves & Savitch LLP

(57) ABSTRACT

A spacer shim for locating between adjacent ground engaging tools of a work implement for an earth working machine includes a shim body, a shim upper protrusion, and a shim retention surface. The shim body includes a shim first leg and a shim second leg spaced apart to form a shim slot for receiving a lip of the work implement. The shim upper protrusion extends from the shim body and is adjacent to the shim first leg. The shim retention surface extends between the forward end and the shim upper protrusion and is configured to contact a bottom surface of a portion of an adjacent ground engaging tool.

20 Claims, 6 Drawing Sheets

SPACER SHIMS FOR GROUND ENGAGING TOOLS

TECHNICAL FIELD

The present disclosure generally pertains to earth working machines with work implements, and is directed toward spacer shims for the ground engaging tools of the work implements.

BACKGROUND

Earth working machines known in the art use work implements, such as dippers or buckets, for digging into work material, such as earth or rock, and moving loosened work material from one place to another at a worksite. Work implements often include ground engaging tools, such as tooth assemblies and shrouds, connected to the lip of the work implement to protect the work implement from abrasion and impact.

U.S. Pat. No. 3,851,413 to Lukavich directed to a replaceable, quick change, segmented cutting edge assembly for a loader bucket or the like. The assembly has a plurality of material engaging teeth which project forwardly from the bucket floor. The assembly comprises a plurality of easily handled, relatively small sections of bifurcated cutting edges. The sections telescopically engage the cutting edge support between the teeth and are mechanically retained on the support by interlock with encompassing protector means for the teeth.

The present disclosure is directed toward overcoming one or more of the problems discovered by the inventors or that is known in the art.

SUMMARY OF THE DISCLOSURE

A spacer shim for locating between adjacent ground engaging tools of a work implement for an earth working machine is disclosed. In embodiments, the spacer shim includes a shim body, a shim upper protrusion, a first side surface, a second side surface, and a shim retention surface. The shim body includes a shim first leg and a shim second leg extending in a first direction away from a forward end and to an aft end of the spacer shim. The shim first leg and the shim second leg being spaced apart to form a shim slot for receiving a lip of the work implement there between. The shim upper protrusion extends from the shim body generally transverse to the shim first leg. The shim upper protrusion is located adjacent the shim first leg. The second side surface is opposite the first side surface. The shim retention surface extends between the forward end and the shim upper protrusion at an angle relative to the first direction. The shim retention surface is adjacent both the first side surface and the second side surface and is configured to contact a bottom surface of a portion of an adjacent ground engaging tool.

DETAILED DESCRIPTION

The systems and methods disclosed herein include a work implement with ground engaging tools for earth working machines. In embodiments, the ground engaging tools include spacer shims located between the various ground engaging tools, such as the adapters for tooth assemblies and lip shrouds. The spacer shims may prevent or reduce the lateral movement of the ground engaging tools caused by lateral forces applied to the work implement during operation of the work implement. The prevention or reduction of lateral movement of the ground engaging tools may prevent or reduce wear on the lip of the work implement.

Figure 1:
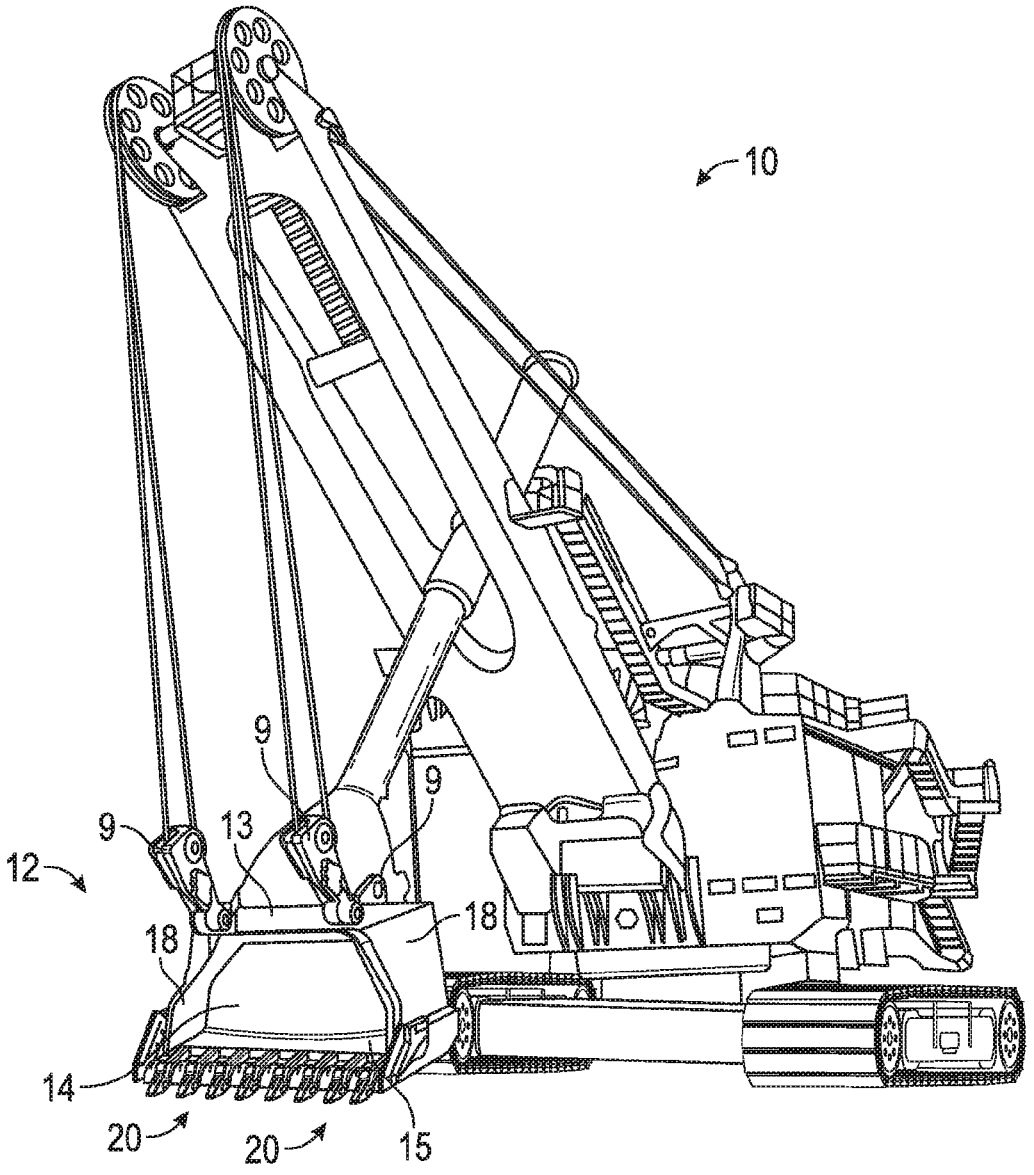
FIG. 1 is a perspective view of an earth working machine.

FIG. 1 is a perspective view of an earth working machine 10. The earth working machine 10, such as an electric rope shovel, excavator, backhoe and the like, includes a work implement 12 operatively connected thereto. The work implement 12, such as a dipper or bucket, may be connected to the earth working machine 10 using a boom, cabling, and the like.

Figure 2:
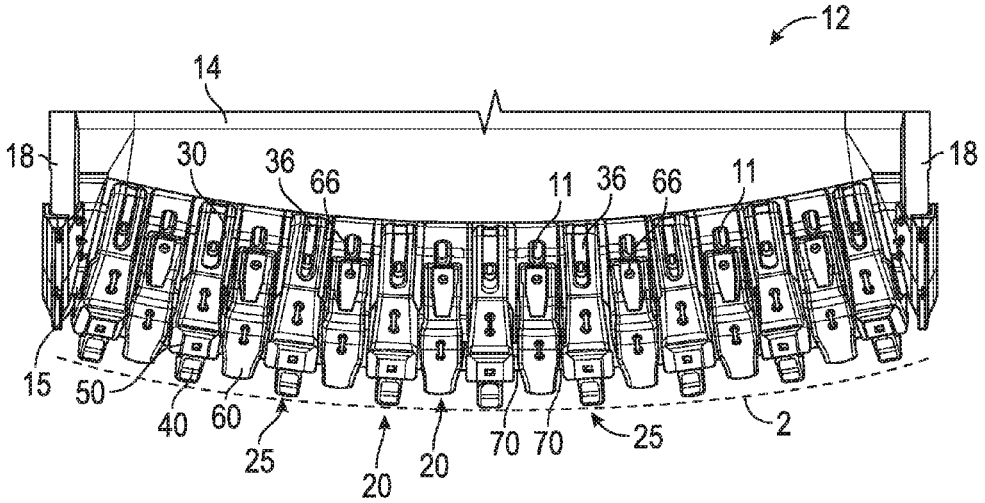
FIG. 2 is a top view of a portion of the work implement of FIG. 1.

FIG. 2 is a top view of a portion of the work implement 12 of FIG. 1. Referring to FIGS. 1 and 2, the work implement 12 may include a body 13, a connection implements 9, ground engaging tools 20, and spacer shims 70 interspersed among the ground engaging tools 20 such that each spacer shim 70 is located between two adjacent ground engaging tools 20, such as two ground engaging tools 20 that are next to each other and either slightly spaced apart or touching in one or more locations. Body 13 may include sidewalls 18, a wrapper plate 14, and an edge plate 15. The sidewalls 18 are generally spaced apart and may generally be oriented in a vertical direction. The wrapper plate 14 may be a curved portion of the work implement 12 and may extend between the sidewalls 18. The wrapper plate 14 and the sidewalls 18 may generally form a container for holding and moving earth, rocks, and other materials. The edge plate 15 extends forward from the wrapper plate 14. The edge plate 15 may be integral to the wrapper plate 14 or may be joined to the wrapper plate 14, such as by a metallurgical bond.

Connection implements 9 are implements, such as hinge plates, snubber assemblies, pitch braces, pins, bushings, and bails that are configured to connect the work implement 12 to the boom, cabling, and the like.

Figure 3:
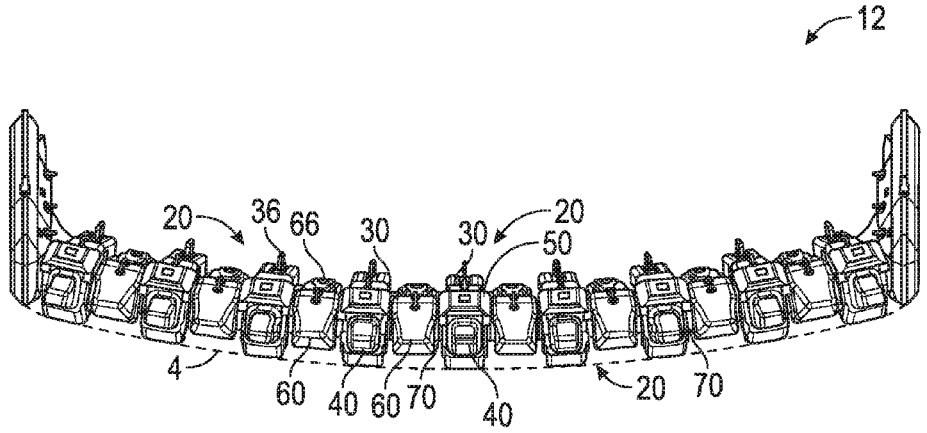
FIG. 3 is front view of the portion of the work implement of FIG. 2.
Figure 4:
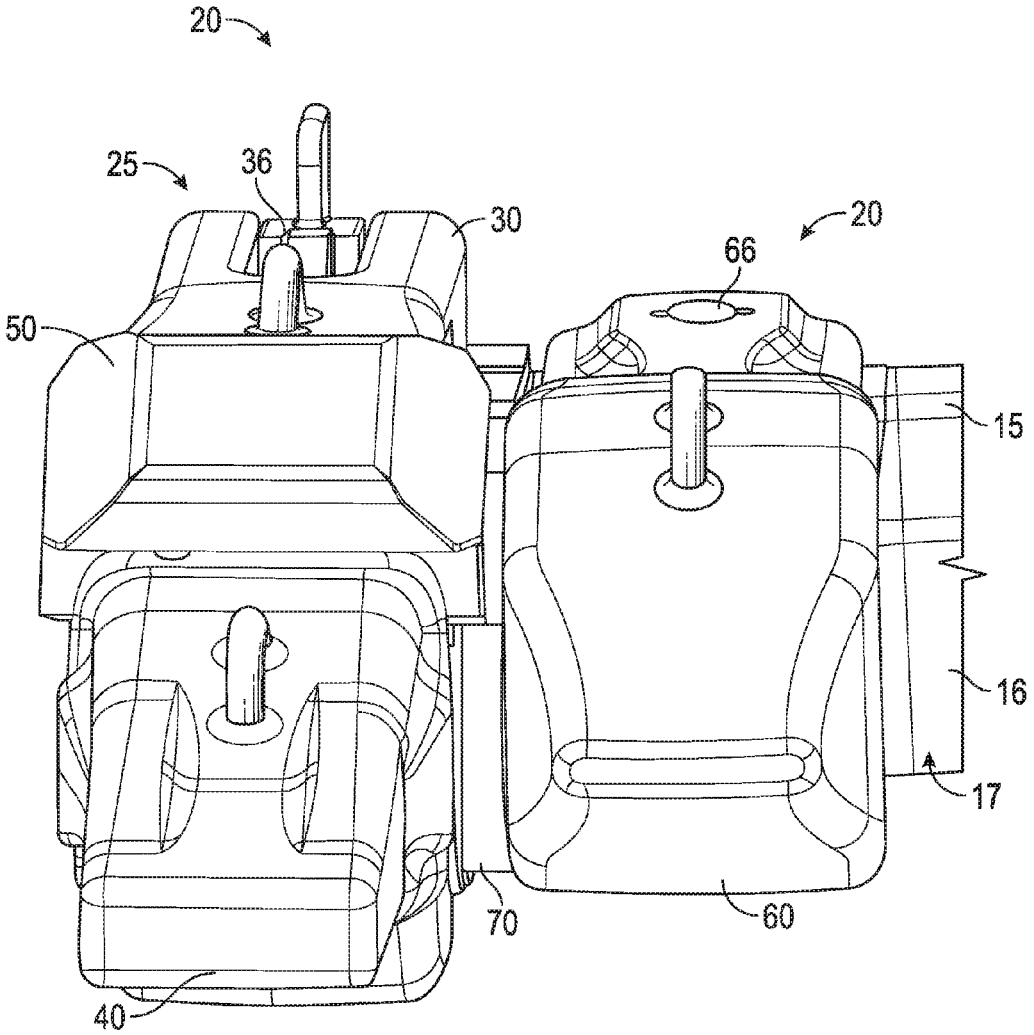
FIG. 4 is a front view of the lip and ground engaging tools for the work implement of FIG. 3.

FIG. 3 is front view of the portion of the work implement 12 of FIG. 2. FIG. 4 is a front view of the lip 16 and ground engaging tools 20 for the work implement of FIG. 3. Referring to FIGS. 2, 3, and 4, the edge plate 15 includes a lip 16 that is distal to the wrapper plate 14. The lip 16 generally extends between the two sidewalls 18. The lip 16 may generally be rounded and include a lip front radius 17. The edge plate 15 may also include apertures 11. Apertures 11 may be used to secure the ground engaging tools 20 to the edge plate 15.

The ground engaging tools 20 are attached to the body 13 at edge plate 15 and are arranged to cover the lip 16. The ground engaging tools 20 may include tooth assemblies 25 and lip shrouds 60. The ground engaging tools 20 may be located along the lip 16 in an alternating pattern, such as placing the tooth assemblies 25 and lip shrouds 60 on the lip 16 in an alternating pattern with spacer shims 70 located there between.

The tooth assemblies 25 may include an adapter 30, a tooth 40, and a wear cap 50. The adapter 30 may include an adapter retention system 36 that is configured to couple the adapter 30 to the body 13, such as to edge plate 15. The adapter retention system 36 may use one or more apertures 11 for securing the tooth assembly 25 to the body 13. The lip shrouds 60 may each include a shroud retention system 66 that is configured to couple the lip shroud 60 to the body 13, such as to the edge plate 15. The shroud retention system 66 may use one or more of the apertures 11 for securing the lip shroud 60 to the body 13.

Figure 5:
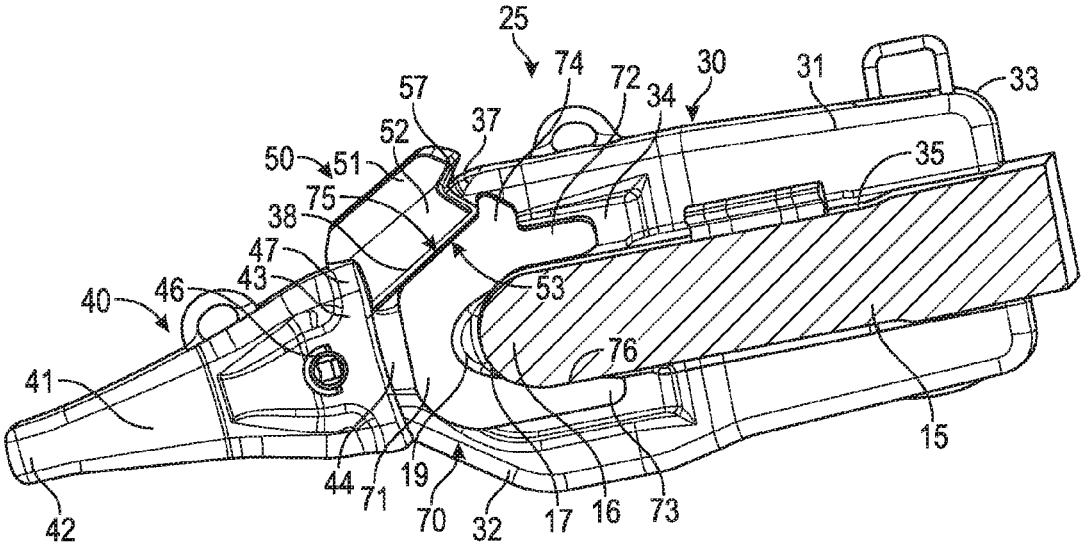
FIG. 5 is a cross-sectional view of the lip and ground engaging tools of FIG. 4.

FIG. 5 is a cross-sectional view of the lip 16 and ground engaging tools 20 of FIG. 4. The edge plate 15 may include stabilizer extrusions 19 extending from the lip. The stabilizer extrusions 19 may be configured to stabilize the ground engaging tools 20, such as the tooth assemblies 25 and the lip shrouds 60 during operation of the work implement 12.

The adapter 30 may include an adapter body 31, an adapter side protrusion 34, an adapter lip slot 35, an adapter cap slot 38, and an adapter upper protrusion 37. The adapter body 31 includes an adapter first end 32 and an adapter second end 33. When coupled to the body 13, the adapter first end 32 is adjacent the lip 16 and the adapter second end 33 is distal to the adapter first end 32 and is positioned along edge plate 15. An adapter side protrusion 34 may extend from each side of adapter body 31. The adapter side protrusions 34 may be located adjacent the adapter first end 32 and may be configured to form contact areas for the spacer shims 70 positioned on each side of the adapter 30.

The adapter lip slot 35 may be a slot that extends into the adapter body 31 from the adapter second end 33 toward the adapter first end 32. The shape of the adapter lip slot 35 may match the shape and contour of the edge plate 15 and the lip 16. In the embodiment illustrated, the adapter lip slot 35 generally has a cuboid shape that has a rounded end, the rounded end being adjacent the adapter first end 32. As illustrated, the adapter lip slot 35 may also extend into the adapter side protrusions 34.

The adapter cap slot 38 may be a slot in the top of the adapter body 31 at the adapter first end 32 and may be adjacent the adapter upper protrusion 37. The adapter cap slot 38 may be formed by the adapter body 31, the adapter upper protrusion 37, and the tooth 40. The adapter cap slot 38 is configured to retain the wear cap 50. The adapter upper protrusion 37 may extend forward from the adapter body 31 and into the adapter cap slot 38 to form a lip that is used to at least partially retain the wear cap 50 within the adapter cap slot 38.

The tooth 40 may include a tooth body 41 and a tooth retention system 46. The tooth body 41 may generally have a wedge shape and includes a tooth first end 42 and a tooth second end 43. The tooth first end 42 is positioned distal to the adapter 30 and may be the narrow portion of the wedge shape. The tooth first end 42 may be positioned to contact the work material first and may be configured to dig into the work material. The tooth second end 43 is positioned adjacent the adapter 30 and may be the wider portion of the wedge shape. An upper portion 47 of the tooth second end 43 may form an edge of the adapter cap slot 38 and may be configured to retain the wear cap 50 within the adapter cap slot 38 with the adapter upper protrusion 37.

The tooth retention system 46 is configured to couple the tooth 40 to the adapter 30. The tooth retention system 46 may include a tooth connector 44 that extends from the tooth second end 43 to the adapter first end 32 to couple the tooth 40 to the adapter 30.

Wear cap 50 includes a wear cap upper portion 51 and a wear cap lower portion 52. The wear cap upper portion 51 is positioned adjacent the adapter first end 32 outside of the adapter cap slot 38. The wear cap upper portion 51 may generally be longer than the adapter cap slot 38 and may be configured to protect a portion of the adapter first end 32 from wear. The wear cap 50 is inserted into the adapter cap slot 38 with the wear cap lower portion 52 positioned within the adapter cap slot 38. The wear cap lower portion 52 includes a wear cap bottom surface 53 distal to the wear cap upper portion 51. The wear cap lower portion 52 may narrow from the wear cap bottom surface 53 to the wear cap upper portion 51 to form a retention neck 57. The wider base of the wear cap lower portion 52 at the wear cap bottom surface 53 may help retain the wear cap 50 within the adapter cap slot 38. In particular, the adapter upper protrusion 37 and the upper portion 47 may protrude into the retention neck 57 to hold the wear cap 50 within the adapter cap slot 38. The wear cap 50 may also be wider than adapter 30 and may be configured to hold the spacer shim 70 in place on the lip 16 adjacent the adapter 30.

Figure 6:
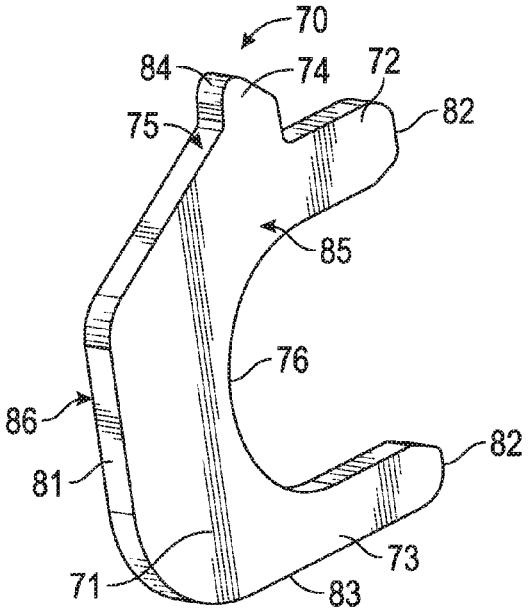
FIG. 6 is a perspective view of the spacer shim of FIG. 5.

FIG. 6 is a perspective view of the spacer shim 70 of FIG. 5. The spacer shim 70 may be a single integral piece. Spacer shim 70 may include a shim body 71, a shim slot 76, a shim retention surface 75, and a shim upper protrusion 74. Shim body 71 may generally be formed in a 'C' shape that fits over and wraps around lip 16. Shim body 71 may include a shim first leg 72 and a shim second leg 73 extending in a first direction away from a forward end 81 and toward an aft end 82 of spacer shim 70. The shim first leg 72 and the shim second leg 73 are spaced apart forming the shim slot 76 there between.

The shim first leg 72 may be adjacent the top 84 of spacer shim 70, while the shim second leg 73 may be at the bottom 85 of spacer shim 70. The shim slot 76 may match the shape and contour of the edge plate 15 and the lip 16. In the embodiment illustrated, the shim slot 76 generally has a cuboid shape that has a rounded end. The shim slot 76 may generally extend into shim body 71 in a direction opposite the first direction from the aft end 82 towards the forward end 81.

The shim retention surface 75 may be a surface angled to face forward and upward extending along an upper part of shim body 71. The shim retention surface 75 may extend between the forward end 81 and the shim upper protrusion 74.

The shim upper protrusion 74 extends up from shim body 71 away from the bottom 83 to the top 84 of the spacer shim 70. The shim upper protrusion 74 extends in a direction away from the shim first leg 72 and the shim second leg 73. Shim upper protrusion 74 may extend transverse, such as perpendicular, to the shim first leg 72 and the shim second leg 73. Shim upper protrusion 74 may be adjacent the shim first leg 72 and may extend from shim body 71 at a location adjacent shim first leg 72. Shim upper protrusion 74 is located between the forward end 81 and the aft end 82 and is generally coplanar to shim body 71 extending on the same plane as shim first leg 72 and shim second leg 73.

Referring to FIG. 5, the shim retention surface 75 is configured to contact a portion of an adjacent ground engaging tool 20, such as the wear cap bottom surface 53, so that the portion of the adjacent ground engaging tool 20, such as the wear cap 50, will retain the spacer shim 70 in place on the lip 16. In the embodiment illustrated, the shim retention surface 75 and the wear cap bottom surface 53 are substantially parallel. The shim upper protrusion 74 extends upward adjacent a protruding portion of an adjacent ground engaging tool 20, such as the wear cap lower portion 52 that may protrude out relative to the adapter body 31, acting as a hook, which may further retain the spacer shim 70 in position between the adapter 30 and the lip shroud 60.

Spacer shim 70 generally includes a first side surface 85 and a second side surface 86. The first side surface 85 and the second side surface 86 are adjacent and configured to contact the ground engaging tools 20 or portions of the ground engaging tools 20, such as the adapter 30 or the lip shroud 60.

Figure 7:
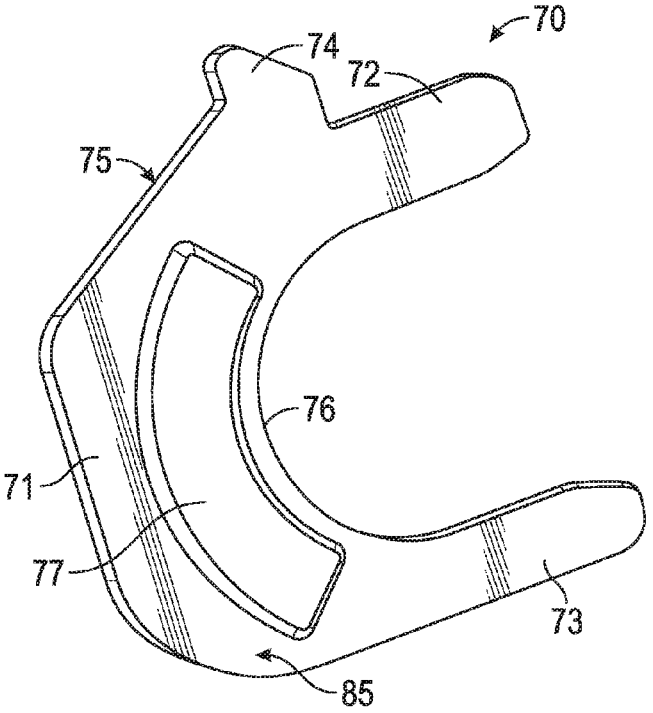
FIG. 7 is a perspective view of an alternate embodiment of the spacer shim of FIG. 6.
Figure 8:
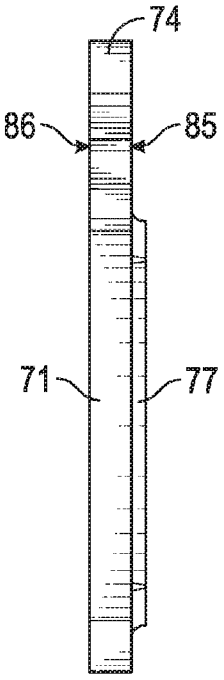
FIG. 8 is a front view of the spacer shim of FIG. 7.

FIG. 7 is a perspective view of an alternate embodiment of the spacer shim 70 of FIG. 6. FIG. 8 is a front view of the spacer shim 70 of FIG. 7. Referring to FIGS. 7 and 8, the spacer shim 70 may include one or more a grinding portions 77 on one of the sides of the spacer shim 70. In the embodiment illustrated, the grinding portion 77 is a single protrusion with an annular sector shape extending from the shim body 71 at the first side surface 85 of the spacer shim 70. In other embodiments, the grinding portion 77 extends from the shim body 71 at the second side surface 86. In yet other embodiments, the spacer shim 70 includes a grinding portion 77 on each side of the shim body 71. In embodiments, the grinding portion 77 is formed from multiple protrusions extending from the shim body 71. Each grinding portion 77 may be positioned between the shim body 71 and the adapter 30, such as adjacent the adapter side protrusion 34, or between the shim body 71 and the lip shroud 60.

Referring to FIG. 2, the lip 16 may curve in the horizontal direction between the sidewalls 18. The horizontal a direction transverse to the direction that the sidewalls 18 extend. As illustrated by the first reference line 2, the lip 16 may curve so that the middle of the lip 16 protrudes forward relative to the sides of the lip 16 adjacent the sidewalls 18. In some embodiments, the curvature has a uniform diameter.

Referring to FIG. 3, the lip 16 may also curve in the vertical direction between the sidewalls 18. The vertical direction is the direction that the sidewalls 18 extend. As illustrated by the second reference line 4, the lip 16 may curve so that the middle of the lip 16 protrudes downward relative to the sides of the lip 16 adjacent the sidewalls 18. In some embodiments, the curvature has a uniform diameter.

Figure 9:
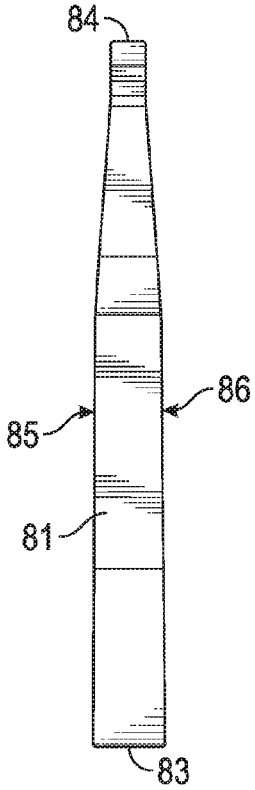
FIG. 9 is a front view of another alternate embodiment of the spacer shim of FIG. 6.
Figure 10:
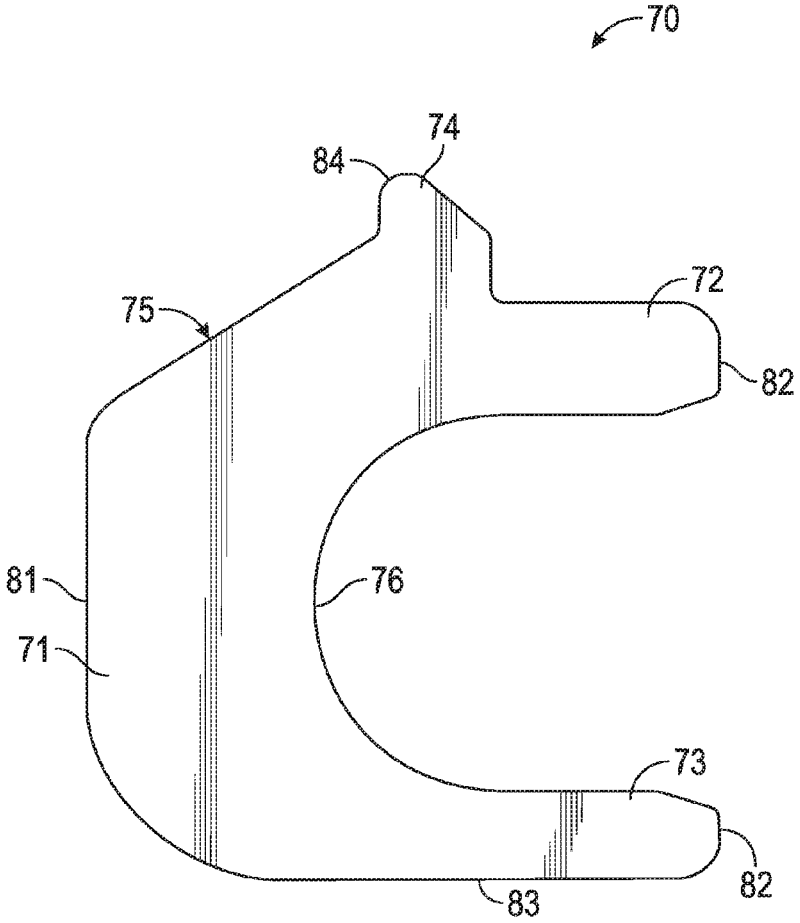
FIG. 10 is a side view of the spacer shim of FIG. 9.
Figure 11:
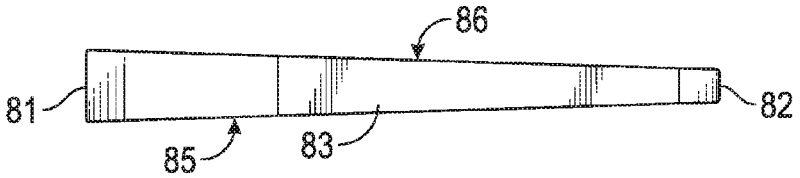
FIG. 11 is a bottom view of the spacer shim of FIG. 9.

FIG. 9 is a front view of another alternate embodiment of the spacer shim 70 of FIG. 6. FIG. 10 is a side view of the spacer shim 70 of FIG. 9. FIG. 11 is a bottom view of the spacer shim 70 of FIG. 9. Referring to FIGS. 3 and 9, spacer shim 70 may be tapered from the bottom 83 to the top 84 in a second direction transverse to the first direction to account for the angle between adjacent portions of ground engaging tools 20, such as an adapter body 31 and the lip shroud 60, that results from the vertical curvature of the lip 16. First side surface 85 and second side surface 86 may curve toward one another and may be closer together at the top 84 at the shim upper protrusion 74 than at the bottom 83 at the shim second leg 73 of the spacer shim 70.

Referring to FIGS. 2 and 11, spacer shim 70 may be tapered from the forward end 81 to the aft end 82 in the first direction to account for an angle between adjacent portions of ground engaging tools 20, such as an adapter body 31 and a lip shroud 60 that results from the horizontal curvature of the lip 16. First side surface 85 and second side surface 86 may curve toward one another and may be closer together at the aft end 82 than at the forward end 81. In some embodiments, spacer shim 70 tapers in both directions to account for the angles that result between adjacent ground engaging tools 20 that result from both the vertical and horizontal curvature of the lip 16.

One or more of the above components (or their subcomponents) may be made from alloy, steel, or cast iron.

INDUSTRIAL APPLICABILITY

Work implements, such as dippers and buckets of earth working machines and tools can be protected against wear by including ground engaging tools 20, such as tooth assemblies 25, edge protectors, lip shrouds 60, and other components. The ground engaging tools 20 are attached to the work implement 12 in the areas where the most damaging abrasion and impact may occur during operation of the earth working machines, such as at the lip 16. The ground engaging tools 20 generally serve as wear material that can be removed and replaced once damaged. The ground engaging tools 20 may prevent or reduce the damage to the work implement 12 and increase the operating life of the work implement 12, preventing early replacement of the work implement 12.

Locating spacer shims 70 between the ground engaging tools 20, such as between an adapter 30 and a lip shroud 60, may prevent or reduce the lateral movement of the ground engaging tools 20 caused by lateral forces applied to a work implement 12 during operation of the work implement 12 by filling the space between adjacent ground engaging tools 20 with the first side surface 85 and the second side surface 86 positioned for contacting the adjacent ground engaging tools 20. Preventing the lateral movement of the ground engaging tools 20 may prevent or reduce wear to the lip front radius 17 and to the stabilizer extrusion 19 of the lip 16. Preventing or reducing the wear to the lip front radius 17 and to the stabilizer extrusion 19 may prolong the operating life of the work implement 12 and may prolong the need to either rebuild the lip 16 or to replace the work implement 12, which helps the customer avoid additional expenses in operating and maintaining the earth working machine 10. Locating spacer shims 70 between the ground engaging tools 20, such as between adapters 30 and lip shrouds 60, may also spread out the lateral forces applied to a work implement 12 during operation of the work by sharing (transferring) the lateral force across multiple ground engaging tools 20 instead of being localized to one ground engaging tool 20.

The shape of the spacer shim 70 including the shim retention surface 75 and the shim upper protrusion 74 may allow the spacer shim 70 to be installed and held in place without the addition of a retention system or retention hardware. Thus, spacer shims 70 may be located between adapters 30 and lip shrouds 60 on new or existing hardware without further modification of that hardware, each spacer shim 70 being held in place by a wear cap 50 that can be either a new or existing wear cap 50 of the work implement 12.

The preceding detailed description is merely exemplary in nature and is not intended to limit the invention or the application and uses of the invention. The described embodiments are not limited to use in conjunction with a particular type of work implement for earth working machines. Hence, although the present disclosure, for convenience of explanation, depicts and describes a particular work implement, it will be appreciated that the ground engaging tools in accordance with this disclosure can be implemented in various other configurations including combinations of various aspects of the embodiments disclosed, can be used with various other types of work implements and earth working machines, and can be used in other types of systems and machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A spacer shim for locating between adjacent ground engaging tools of a work implement for an earth working machine, the spacer shim comprising:

a shim body including a shim first leg and a shim second leg both extending in a first direction away from a forward end and to an aft end of the spacer shim, the shim first leg and the shim second leg being spaced apart to form a shim slot for receiving a lip of the work implement there between;

a shim upper protrusion adjacent the shim first leg extending from the shim body in a second direction away from the shim first leg and the shim second leg;

a first side surface; and a second side surface opposite the first side surface, wherein the first side surface and the second side surface define a thickness of the spacer shim, the thickness defining the minimum dimension of the spacer shim, wherein the first side surface and the second side surface are configured to engage a ground engaging tool on either side of the spacer shim.

2. The spacer shim of claim 1, further comprising a shim retention surface extending between the forward end and the shim upper protrusion at an angle relative to the first direction, the shim retention surface being adjacent both the first side surface and the second side surface, and being configured to contact a bottom surface of a portion of an adjacent ground engaging tool.

3. The spacer shim of claim 1, further comprising a first grinding portion extending on the first side surface.

4. The spacer shim of claim 3, further comprising a second grinding portion on the second side surface, the second grinding portion extending from the second side surface in a third direction opposite the first grinding portion.

5. The spacer shim of claim 3, wherein the first grinding portion includes an annular sector shape located between the shim slot and the forward end.

6. The spacer shim of claim 1, wherein the spacer shim is tapered in the second direction transverse to the first direction with the first side surface being closer to the second side surface at the shim upper protrusion than at the shim second leg.

7. The spacer shim of claim 1, wherein the spacer shim is tapered in the first direction with the first side surface being closer to the second side surface at the aft end than at the forward end.

8. A work implement for an earth working machine, the work implement comprising:

a body including two sidewalls and a lip extending there between;

a plurality of ground engaging tools attached to the body and arranged to cover the lip, the plurality of ground engaging tools being arranged in a pattern that extends along the lip between the two sidewalls; and a plurality of spacer shims located on the lip and interspersed among the plurality of ground engaging tools such that each spacer shim of the plurality of spacer shims is located between two adjacent ground engaging tools of the plurality of ground engaging tools, each spacer shim including a shim body with a 'C' shape including a shim first leg and a shim second leg, the shim first leg and the shim second leg extending away from a forward end to an aft end, a first side surface for contacting a first ground engaging tool, a second side surface opposite the first side surface for contacting a second ground engaging tool adjacent the first ground engaging tool, and a shim upper protrusion adjacent the shim first leg extending from the shim body adjacent a protruding portion of the first ground engaging tool, the shim upper protrusion acting as a hook to retain the spacer shim on the lip of the body.

9. The work implement of claim 8, wherein one or more of the plurality of spacer shims includes a shim retention surface extending between the forward end and the shim upper protrusion, the shim retention surface being in contact with the first ground engaging tool to retain the spacer shim on the lip of the body.

10. The work implement of claim 8, wherein one or more of the plurality of spacer shims includes a first grinding portion on the first side surface.

11. The work implement of claim 10, wherein one or more of the plurality of spacer shims includes a second grinding portion on the second side surface, the second grinding portion extending from the second side surface in a direction opposite the first grinding portion.

12. The work implement of claim 8, wherein the lip curves in a vertical direction and one or more of the plurality of spacer shims is tapered to account for a curvature of the lip.

13. The work implement of claim 8, wherein the lip curves in a horizontal direction and one or more of the plurality of spacer shims is tapered to account for a curvature of the lip.

14. A dipper for an earth working machine, the dipper comprising:

a body including two sidewalls and a lip extending there between;

a tooth assembly including an adapter joined to the body at the lip, the adapter including an adapter body including an adapter first end and an adapter upper protrusion extending from the adapter body adjacent the adapter first end, a tooth joined to the adapter at the adapter first end, an adapter cap slot formed at the adapter first end by the adapter body, the adapter upper protrusion and the tooth, and a wear cap inserted into the adapter cap slot, the wear cap including a bottom surface that contacts the adapter body;

a lip shroud joined to the body at the lip adjacent to the adapter; and a spacer shim located between the adapter body and the lip shroud, the spacer shim including a shim body including a 'C' shape that wraps around the lip, the shim body including a first side surface adjacent the lip shroud and a second side surface adjacent the adapter, a shim upper protrusion extending up from the shim body adjacent the wear cap, and a shim retention surface adjacent the shim upper protrusion, the shim retention surface being in contact with the bottom surface to hold the spacer shim in place on over the lip.

15. The dipper of claim 14, wherein the spacer shim includes a grinding portion on the first side surface toward the lip shroud.

16. The dipper of claim 14, wherein the spacer shim includes a grinding portion on the second side surface toward the adapter.

17. The dipper of claim 14, wherein the adapter includes a side protrusion extending from the adapter body, and wherein the second side surface contacts the side protrusion.

18. The dipper of claim 14, wherein the lip curves in a vertical direction, and wherein the spacer shim is tapered to account for an angle between the adapter body and the lip shroud that results from the vertical curvature of the lip.

19. The dipper of claim 14, wherein the lip curves in a horizontal direction, and wherein the spacer shim is tapered to account for an angle between the adapter body and the lip shroud that results from the horizontal curvature of the lip.

20. The dipper of claim 14, wherein the lip curves in a vertical direction and in a horizontal direction, and wherein the spacer shim is tapered to account for an angle between the adapter body and the lip shroud that results from the vertical curvature and the horizontal curvature of the lip.

* * * * *